US005117906A

United States Patent [19]

Giusti, Jr. et al.

[11] Patent Number: 5,117,906

[45] Date of Patent: Jun. 2, 1992

[54] COMPACT, RETRIEVABLE PACKER

[75] Inventors: Frank Giusti, Jr., Lewisville; Henry L. Restarick, Plano; John R. Setterberg, Jr., Dallas; Pat. M. White, Carrollton, all of Tex.

[73] Assignee: Otis Engineering Corporation, Carrollton, Tex.

[21] Appl. No.: 657,728

[22] Filed: Feb. 19, 1991

[51] Int. Cl.[5] ..... E21B 43/128; E21B 43/129

[52] U.S. Cl. ..... 166/120; 166/212; 166/217

[58] Field of Search ..... 166/120, 217, 212, 118, 166/134

[56] References Cited

U.S. PATENT DOCUMENTS

| | | | |
|---|---|---|---|
| Re. 31,933 | 7/1985 | Taylor et al. | 166/120 |
| 3,054,450 | 9/1962 | Baker | 166/120 |
| 3,120,269 | 2/1964 | Evans et al. | 166/120 |
| 3,265,132 | 8/1966 | Edwards, Jr. | 166/120 |
| 4,018,272 | 4/1977 | Brown et al. | 166/120 X |
| 4,505,332 | 3/1985 | Mills et al. | 166/120 |
| 4,697,640 | 10/1987 | Szarka | 166/120 |

*Primary Examiner*—Stephen J. Novosad
*Attorney, Agent, or Firm*—Dennis T. Griggs

[57] ABSTRACT

A compact, retrievable packer has a unitary mandrel body which is intersected by one or more longitudinal bores. The effective running length of the packer is reduced by an improved arrangement of packer components which serve multiple functions. The hydraulic actuator includes a cylinder housing which also serves as an internal slip housing, a lower element retainer, a piston extension, and a part of the release apparatus. A release sleeve serves as a part of the release apparatus, as a mandrel for engaging a locking slip, and forms a fixed boundary of the hydraulic pressure chamber. The effective running length of the packer is further reduced by making the upper wedge for reacting the setting forces as an integral part of the packer mandrel body.

20 Claims, 4 Drawing Sheets

COMPACT, RETRIEVABLE PACKER

FIELD OF THE INVENTION

This invention relates to tools and equipment for completing subterranean wells, and in particular to retrievable well packers for securely sealing the annulus between a tubing string and the bore of a surrounding well casing.

BACKGROUND OF THE INVENTION

In the course of treating and preparing subterranean wells for production, a well packer is run into the well on a work string or production tubing. The purpose of the packer is to support production tubing and other completion equipment such as a screen or safety valve adjacent to a producing formation and to seal the annulus between the outside of the production tubing and the inside of the well casing to block movement of fluids through the annulus past the packer location. The packer is provided with slip anchor members having opposed camming surfaces which cooperate with complementary opposed wedging surfaces, whereby the slip anchor members are extendable radially into gripping engagement against the well casing bore in response to relative axial movement of the wedging surfaces or button slips. The packer also carries annular seal elements which expand radially into sealing engagement against the bore of the well casing in response to axial compression forces. Longitudinal movement of the packer components which set the anchor slips and the sealing elements may be produced either hydraulically or mechanically.

DESCRIPTION OF THE PRIOR ART

In hydraulically actuated packers, the setting piston is constantly exposed to pressure fluctuations. The annular piston seals are subjected to buffeting surge forces which are transmitted through the hydraulic actuator. As a result of such buffeting forces, the annular piston seal elements may become prematurely worn and leak. A leaky piston may in some instances, where the piston is mounted above the packer seal elements, interrupt the sealing engagement between the packer and the surrounding well casing bore. If sealing engagement is impaired or destroyed, it may be difficult or impossible to restore the sealed connection between the tubing string and the well bore.

Other conventional packers have included setting apparatus with shear pins which provide packer release sequence control. Under certain operating conditions, premature shearing of the release pins can occur as a result of the static production loading from above the packer and pressure loading applied from below the packer.

In hydraulically actuated packers, the packer mandrel may be subject to burst and collapse as the hydraulic pressure is increased, or pressure differentials above or below increase, and greater setting force is applied to the piston. This causes ratchet slips to lock tighter, and the radial component of the locking force may pinch or collapse the tubular mandrel. Collapse is even more likely to occur for dual bore hydraulic packers in which thin walled mandrels provide increased diameter production bores. For such packers in which external ratchet slips engage the dual mandrels, the mandrel wall thickness must be increased and/or the hydraulic setting pressure must be limited to avoid collapse or pinching damage.

The effective running length of conventional dual bore packers is in the range of 8–9 feet. The combined effect of its running length, outside diameter and stiffness are factors which limit the use of such conventional dual bore packers in deviated bores or horizontal completions. Such conventional packers cannot negotiate short, medium and long radius horizontal completions. Short radius completions are characterized by bend sections having an angular turn rate of about 1 to 3 degrees per foot of horizontal displacement; medium radius completions, about 7 to 50 degrees per 100 feet of horizontal displacement; and, long radius completions, about 1 to 6 degrees per 100 feet of horizontal displacement.

OBJECTS OF THE INVENTION

Accordingly, the principal object of the present invention is to reduce the effective running length of a well packer so that it can be run through a highly deviated bore, for example short, medium and long radius horizontal well completions.

Another object of the invention is to provide an improved multiple bore hydraulic packer which utilizes a unitary mandrel body which is capable of withstanding increased setting pressures without collapse or other failure.

Yet another object of the present invention is to provide an improved hydraulic packer in which the number and size of seals required to seal the setting piston is reduced.

A related object of the present invention is to provide an improved hydraulic packer in which the setting piston and seal elements are arranged so that the annulus pressure differential is minimized across the 0-ring seals of the setting piston.

Still another object of the present invention is to provide an improved retrievable packer in which the net pressure loading applied to release shear screws as a result of loading forces imposed from above or below the packer during production operations is minimized.

Another object of the present invention is to improve the weight carrying capacity of a multiple bore hydraulic packer.

SUMMARY OF THE INVENTION

The foregoing objects are achieved according to the present invention by a hydraulic packer having a unitary mandrel body which is intersected by one or more longitudinal bores. The effective running length of the packer is reduced by an improved arrangement of packer components which serve multiple functions. In the preferred embodiment, the hydraulic actuator includes a cylinder housing which also serves as an internal slip housing, a lower element retainer, a piston extension, and as part of the release apparatus. A release sleeve serves as a part of the release apparatus, as a mandrel for engaging a locking slip, and as a fixed boundary of the hydraulic pressure chamber. The effective running length of the packer is further reduced by making the upper wedge for reacting the setting forces as an integral part of the packer mandrel body. Since the mandrel body is solid, its weight carrying capacity is substantially increased as compared with the capacity of thin walled, dual mandrel packers.

The number of 0-ring seals required to seal the setting piston is minimized by locating the setting piston below the seal elements. In this embodiment, a leakage path will not be formed around the 0-ring seals because the pressure within the setting chamber is essentially the same as the pressure in the annulus below the seal elements.

The release shear screws are protected against premature separation by locating the anchor slips above the seal elements. If there is substantial pressure from below, the effective pressure working on the release shear screws is applied across the limited mandrel cross section. Loading imposed by the tubing string above the packer is reacted through the packer mandrel and anchor slips into the surrounding well casing.

The novel features of the invention are set forth with particularity in the claims. The invention will best be understood from the following description when read with reference to the accompanying drawings.

DETAILED DESCRIPTION OF THE PREFERRED EMBODIMENT

Figure 1:
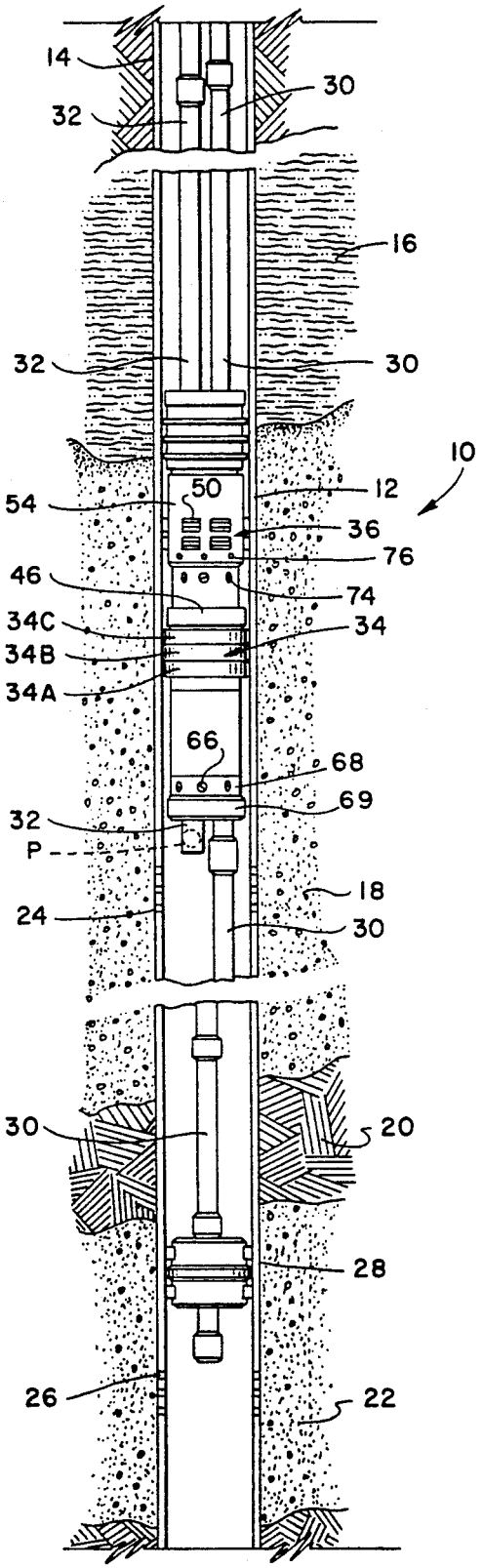
FIG. 1 is a simplified schematic diagram showing a production well intersecting two hydrocarbon producing formations, with the lower producing formation being isolated by a single string bottom packer, and with the upper formation being isolated by a dual hydraulic production packer constructed according to the teachings of the present invention.

In the description which follows, like parts are marked throughout the specification and drawings with the same reference numerals, respectively. The drawings are not necessarily to scale and the proportions of certain parts have been exaggerated to better illustrate details and features of the invention. As used herein, the designation "S" refers to internal and external 0-ring seals and the designation "T" refers to a threaded union.

Apparatus constructed according to a first embodiment of the present invention in the form of a dual string hydraulic well packer 10 is shown in releasably set, sealed engagement against the bore 12 of a tubular well casing 14. The tubular casing string 14 extends through multiple layers of overburden 16, traversing a first hydrocarbon formation 18, intersects one or more layers of underburden 20 and then intersects a second hydrocarbon formation 22. The tubular casing sections which l intersect the hydrocarbon formations 18 and 22 are perforated by multiple openings 24, 26, respectively, formed through the casing sidewall to permit entry of formation fluids from the producing formations 18, 22, respectively.

The well is sealed by a bottom packer 28 with an expendable sealing plug in place, which is set by electric wire line for isolation of the lower production zone 22 after perforating and while working on the upper producing zone 18. After perforating the upper producing zone 18, the dual hydraulic packer 10 is installed. The expendable sealing plug in the bottom packer 18 is pushed out as a primary production string 30 is landed.

Each production zone 18, 22 is separately produced through an independent, primary tubing string 30 and a secondary tubing string 32. The dual production tubing strings 30, 32 are extended to a surface wellhead assembly (not illustrated).

Figure 2:
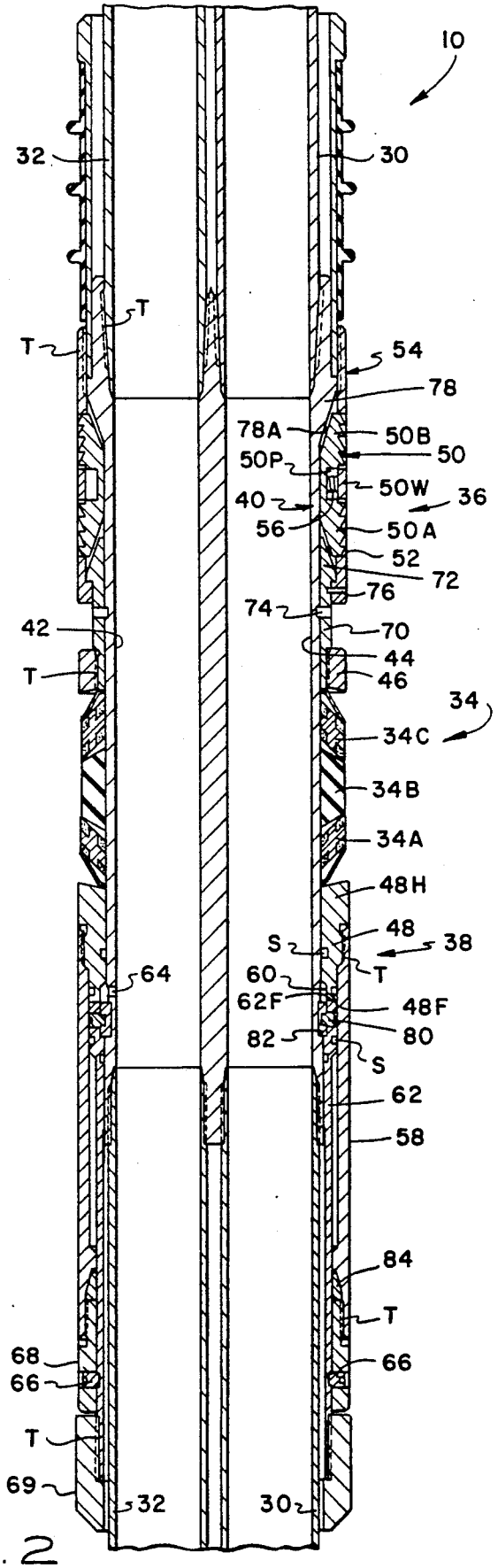
FIG. 2 is a longitudinal sectional view of the dual string production packer shown in FIG. 1.

Referring now to FIGS. 1 and 2, the dual bore hydraulic packer 10 includes an expandable seal assembly 34 and a slip anchoring assembly 36, both radially extendable as described hereinafter to engage the bore 12 of the surrounding well casing 14. Additionally, the dual bore packer 10 includes a hydraulic actuator assembly 38 slidably mounted in sealing engagement onto a unitary packer mandrel body 40. The unitary packer mandrel body 40 is intersected by longitudinal flow passages 42, 44, which are connected in flow communication with the dual production tubing strings 30, 32.

The seal element assembly 34 is mounted directly onto the external surface of the packer body mandrel 40. The expandable seal assembly 34 includes a lower end seal element 34A, a center seal element 34B and an upper end seal element 34C. A two element package or single element package can be used, as desired. The outside seal elements 34A, 34C are preferably made of graphite impregnated wire mesh and the center seal element 34B is preferably made of a resilient polymeric material. The seal elements are rated for steam service at 550 degrees F and are stacked in concentric alignment about a longitudinal axis between an upper element retainer 46 and the head 48H of a setting piston 48. Elastomeric/nitrile seal elements may be used for standard service applications. The type, shape, number and method of mounting the seal elements included in seal assembly 34 may be varied as known in the art while still providing a seal assembly that may be expanded radially to selectively engage a well bore surrounding the packer 10.

The slip anchor assembly 36 includes a plurality of anchor slips 50 which are mounted for radial movement through rectangular windows 52 formed in a tubular slip carrier 54. While the number of anchor slips 50 may be varied, the tubular slip carrier 54 is provided with an appropriate corresponding number of windows 52, with four anchor slips 50 being preferred. Each of the anchor slips 50 includes lower and upper gripping surfaces 50A, 50B, respectively, positioned to extend radially through the windows 52. The wall area 54W of the slip carrier 54 between the paired rectangular windows 52 confines a coil or leaf spring 56 which resides in a pocket 50P of the anchor slip 50.

The coil spring 56 biases the anchor slip 50 radially inwardly relative to the wall 54W of the slip carrier 54, thereby maintaining the gripping surfaces 50A, 50B retracted in the absence of setting forces displacing the anchor slips radially outwardly. Each of the gripping surfaces 50A, 50B has horizontally oriented gripping edges which provide gripping engagement in each direction of longitudinal movement of the packer 10. The gripping edges are radially curved to conform with the cylindrical internal surface of the well casing bore 12 against which the anchor slips 50 are set.

The expandable seal elements 34A, 34B, 34C have longitudinally aligned bores through which the packer mandrel 40 is received in slidable, sealing engagement therewith.

The hydraulic actuator assembly 38 includes the annular setting piston 48 and a setting cylinder 58. The setting cylinder 58 has a cylindrical sidewall which is secured to the piston 48 by a threaded union T. The external surface of the setting piston 48 is sealed against the inside diameter bore of the setting cylinder by 0-ring seals S. The internal bore surface of the setting piston 48 is sealed against the external surface of the packer mandrel 40 by an 0-ring seal S.

The piston 48 has an end face 48F which defines the upper boundary of a variable volume pressure chamber 60. The lower boundary of the variable volume pressure chamber 60 is defined by the annular end face 62F of a release sleeve 62. The external sidewall of the packer mandrel 40 and the internal sidewall of the setting cylinder 58 define radial boundaries for the chamber 60.

Hydraulic fluid enters the pressure chamber 60 through a flow port 64. The flow port 64 is a small radial bore which radially intersects the packer mandrel 40. According to this arrangement, the flow passage 42 is closed by a plug P, such as a drop ball which is dropped through the bore of the tubing string 32. After the flow passage 42 is closed, the mandrel bore 42 is pressurized with hydraulic fluid pumped through the secondary tubing string 32. Hydraulic fluid flows through the setting port 64 into the hydraulic pressure chamber 60, thereby applying hydraulic pressure against the piston face 48F and the guide tube face 62F In the run position as shown in FIG. 2, the setting piston 48 and setting cylinder 58 are releasably restrained against extension movement by shear screws 66. The shear screws 66 are threaded into tapped bores formed in a cylinder cap 68, and project into blind bores formed n the release sleeve 62. The cylinder cap 68 is blocked against downward displacement by a retainer collar 69. The retainer collar 69 is threaded onto the lower end of the release sleeve 62, and is radially spaced from the tubing strings 30, 32. According to this arrangement, the setting piston 48 is releasable blocked from extension against the expandable packing seal elements 34 during run in.

The setting forces are transmitted to the anchor slips 50 through the seal element assembly 34 to a movable setting wedge 70. The setting wedge 70 includes a slip cone 72 which is engagable with the anchor slip assembly 36. The setting sedge 70 is secured against inadvertent set while running into the hole by shear pins 74 which connect to the packer mandrel 40. The setting wedge is also secured by shear pins 76 which connect to the slip carrier 54.

According to an important feature of the invention, the packer mandrel 40 has a fixed tubular wedge 78 for engagement by the anchor slips for limiting longitudinal travel of the anchor slips and for reacting setting forces transmitted by the setting piston 48 through the seal element assembly 34, the setting wedge 70 and the anchor slip assembly 36. The fixed setting wedge 78 has a spreader cone with an upwardly facing frustoconical wedging surface 78A which is generally complementary to a downwardly facing cam surface formed on the anchor slip 50B. Likewise, the slip cone 72 of the setting wedge 70 has a downwardly facing frustoconical wedging surface which is generally complementary to a downwardly facing cam surface formed on the anchor slip 50. In this arrangement, the seal element assembly 34 and the tubular wedge are mounted intermediate the piston 48 and the anchor slip assembly 36.

Axial compression forces transmitted by the piston 38 through the seal element assembly 34 are reacted through the top wedge 78 and the release sleeve 62. The release sleeve 62 is releasably attached to the packer mandrel body 40 by a shear screw 80. Preferably, the shear screw 80 projects into a blind bore formed in a snap ring 82. The snap ring 82 is received within an annular slot which intersects the external surface of the packer mandrel 40.

As the piston 48 is extended upwardly in response to pressurization of the variable volume pressure chamber 60, reaction forces are transmitted through the seal element assembly 34 and setting wedge 70 onto the anchor slip assembly 36, and are reacted by the fixed wedge 78 as the anchor slip assembly is extended radially outwardly. The compression forces are also transmitted through the release shear screws 80 to the packer mandrel 40 and through the shear screws 66 to the release sleeve 62. In the run in position as illustrated in FIG. 2, the setting wedge 72 is fully retracted relative to the anchor slip assembly 36, and consequently, the anchor slips 50 are fully retracted within the windows 52 by the coiled compression springs 56. As the conical wedge surface of the setting wedge 72 is driven into engagement with the sloping wedge surface of the anchor slip 50A, the anchor slips are displaced radially outwardly as the upper and lower spreader cones engage and slip along the sloping cam surfaces.

The set position of the piston 48 and the setting cylinder 58 is secured by the unidirectional ratcheting action of a set of segmented, internal locking slips 84 which are interposed between the cylinder 58 and the release sleeve 62. The ratchet slips 84 are received within a slip pocket having a tapered counterbore formed along the inside bore of the setting cylinder 58.

Each locking slip has coarse, upwardly facing buttress threads which engage and bite into the external surface of the release sleeve 62. The buttress threads permit the setting cylinder 58 to ratchet upwardly along the release sleeve surface 62 as the piston 48 is extended, but downward retraction movement is prevented by the wedging action and biting engagement of the locking slip against the release sleeve 62. The locking action of the ratchet slips 84 against the release sleeve 62 prevents downward retraction movement since retraction would cause the buttress threads to wedge the slips even tighter into biting engagement against the setting sleeve. Consequently, once the setting cylinder 58 and the piston 48 have been driven upwardly and fully extended into compressive engagement against the annular seal elements 34, the setting wedge 70 is concurrently moved upwardly, driving the anchor slips into set engagement against the well bore 12. The set position is securely locked against retraction by the locking slips after the hydraulic setting I pressure has been removed.

After the secondary packer mandrel 42 has been plugged, hydraulic fluid is pumped into the closed mandrel and is ported into the variable volume pressure chamber 60 and acts upon the piston head 48H and on the head of the release sleeve 62. The setting cylinder 58 is connected to the cylinder cap 68 by a threaded union T. Shear screws 66 releasably connect the cylinder cap 68 to the release sleeve 62. Upon application of hydraulic pressure into the variable volume pressure chamber 60, the pressure force is increased until the shear strength of the shear screws 66 is overcome. As the shear screws 66 separate, the setting cylinder 58 is released and is extended along with the piston 48 against the annular packing seal element 34A. After the upper shear screws 74, 76 separate, the piston drives the spreader cone 72 into engagement with the anchor slips 48.

After the seal elements 34 and anchor slips 50 have been set, hydraulic pressure is relieved and the plug P is removed, for example by a wire line tool, or by pressurizing the secondary mandrel until the plug housing seat is fractured and the plug P is discharged into the annulus above the bottom packer 28. The well is then completed and ready for production.

The packer 10 is releasable from the set configuration by a straight pull of the primary tubing string 30 relative to the secondary tubing string 32. As the primary tubing string 30 is pulled upwardly, the release shear screws 80 separate, and the compression forces stored within the seal elements 34 push the piston 48 and setting cylinder 58 downwardly along the packer mandrel. After the pressure on the setting wedge 70 has been. released due to relaxation of the seal elements, the mandrel 40 is picked up and the shoulder on top of the mandrel engages the slip carrier as the mandrel is pulled upwardly, with the fixed wedge 78 being pulled away from the anchor slip. Accordingly, the anchor slips 36 are then free to retract. As the packer mandrel engages the shoulder of the slip carrier 54, the slip carrier pulls on the bottom section of the anchor slip assembly to pull it away from the wedge. As the mandrel is being picked up, the window frame of the slip carrier engages the lower anchor slip along its shoulder, thereby pulling it away from the wedge 72. Upon separation of the release shear screws 80, the piston 48, setting cylinder 58 and release sleeve 62 become unsupported and fall into the annulus below the packer.

It will be appreciated that the effective running length of the packer 10 is substantially reduced by the foregoing arrangement of packer components which serve multiple functions. In the embodiment of FIG. 2, the hydraulic actuator assembly includes the cylinder housing 58 which also serves as an internal slip housing for the ratchet slips 84, a lower element retainer, a piston extension, and as part of the release apparatus. The release sleeve 62 serves as a mandrel for engaging the locking slip 84, and as a fixed boundary of the hydraulic setting chamber 60. The upper wedge 78 is integrally formed with the packer mandrel, thereby further reducing the effective running length of the packer 10. A length savings of about 6 inches per component is thus achieved, providing a 7 inch O.D. packer having an effective running length of about 28 inches.

Since the piston assembly is mounted on the mandrel below the seal element assembly 34, only two 0-ring seals are required to seal the setting piston 48 since the pressure within the setting chamber 60 is essentially the same as the pressure in the annulus below the packer.

The release shear screws 80 are protected against premature separation during production by locating the anchor slip assembly 36 above the seal elements 34. According to this arrangement, any pressure applied from below the packer acts across the limited mandrel cross section area. Loading imposed by the tubing strings 30, 32 above the packer is reacted through the packer mandrel and the anchor slips into the surrounding well casing.

The dual bore packer mandrel body 40 is substantially stronger than conventional dual bore packers which utilize separate packer mandrels for supporting the anchor slips. Accordingly, the collapse strength and weight carrying capacity of the packer 10 are substantially increased as compared with conventional thin walled, dual mandrel packers.

Figure 3:
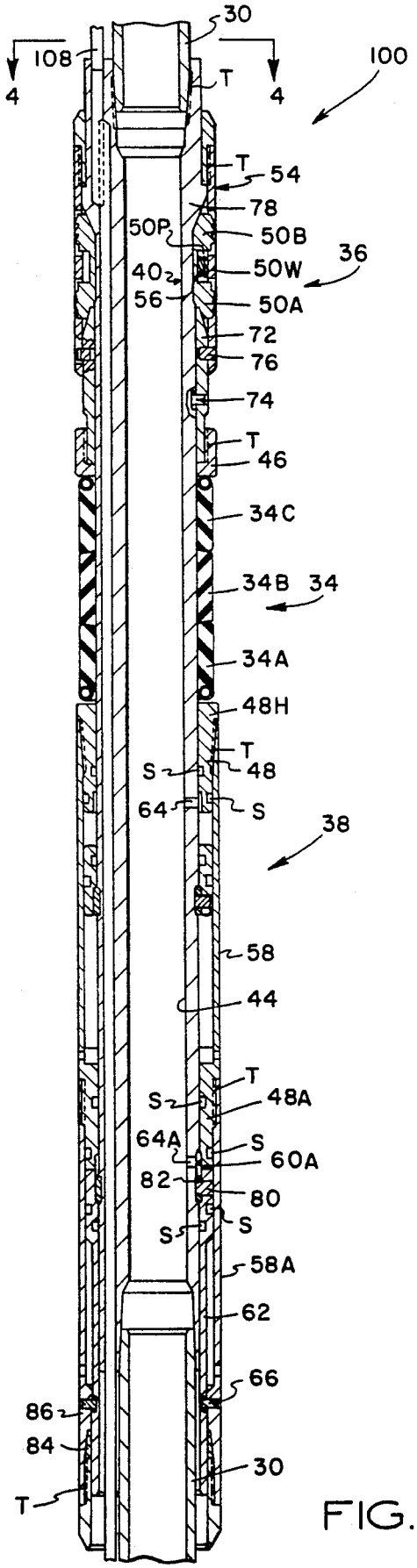
FIG. 3 is a longitudinal sectional view of an alternative embodiment of the present invention in which a hydraulic packer has a single production bore and multiple auxiliary bores.
Figure 4:
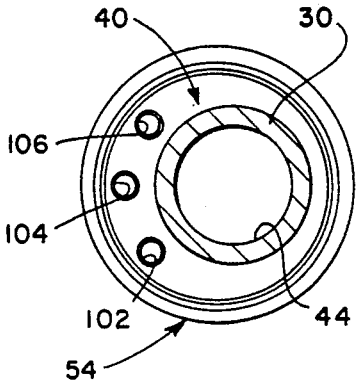
FIG. 4 is a sectional view taken along the lines 4—4 of FIG. 3.

Referring now to FIGS. 3 and 4, the present invention is embodied in a multiple bore packer 100 having a single production bore 44 and multiple auxiliary bores 102, 104 and 106. In this embodiment, the solid mandrel 40 is intersected longitudinally by the production bore 44 to which the production tubing 30 is connected in flow communication by a threaded union T. The auxiliary bores 102, 104, 106 are likewise connected in fluid communication with auxiliary conduits 108, 110 and 112. The auxiliary bores may be utilized for downhole sensing purposes, for conveying control fluid for operating a subsurface safety valve, as conduits for conveying pneumatic or hydraulic operating fluid for a submersible pump, or as a passage for routing electrical wiring for supplying electrical operating power to a submersible pump.

The hydraulic actuator assembly 38 includes a dual piston arrangement in which the setting force developed by the setting piston 48 is augmented by an auxiliary piston 48A. The auxiliary piston 48A is connected to the primary piston 48 by the setting cylinder 58. The auxiliary piston 48A is releasably coupled to the release sleeve 62 by a setting cylinder extension sleeve 58A. An auxiliary flow port 64A intersects the sidewall of the packer mandrel 40 for admitting pressurized hydraulic fluid into an auxiliary pressure chamber 60A. The boundaries of the auxiliary pressure chamber 60A are defined by the lower face of the auxiliary piston 48A, the top face of the setting sleeve 62, by the sidewall of the packer mandrel 40 and by the internal bore of the setting cylinder extension sleeve 58A.

The packer 100 is set and released in the same manner as the packer 10.

Figure 5:
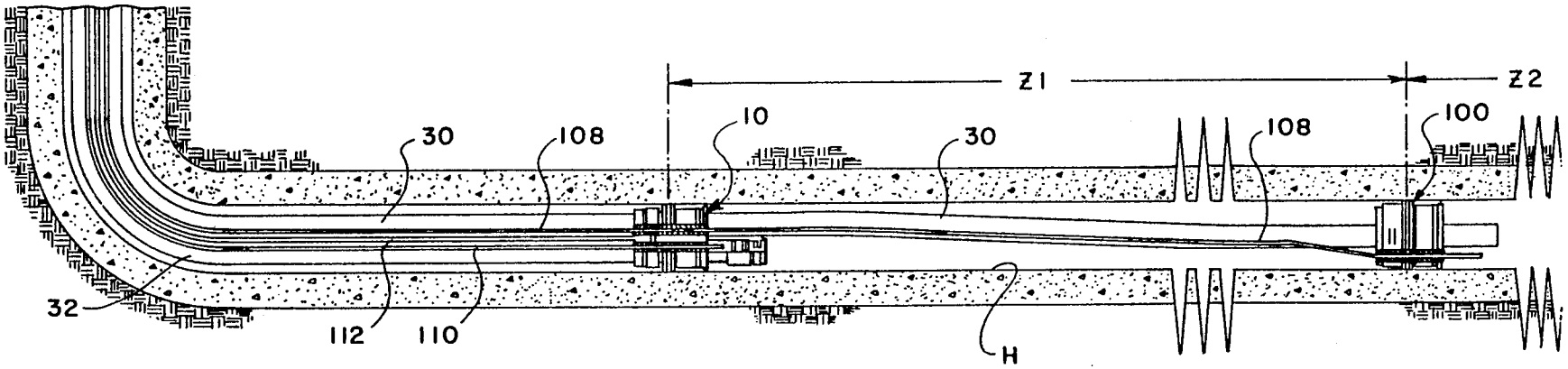
FIG. 5 is a simplified sectional view which illustrates the installation of the compact, multiple bore packer of the present invention in a horizontal well completion; and, FIG. 6 is a longitudinal sectional view of an alternative embodiment of a retrievable well packer in which the multiple function set/release components of the present invention are implemented in a retrievable, dual bore hydraulic packer having opposing anchor slips.

Referring now to FIG. 5, an application of the dual bore packer 10 in combination with the dual piston, multiple bore packer 100 is illustrated in a horizontal completion. In FIG. 5, the packer 10 and packer 100 are inserted into a horizontal well bore H which penetrates through a horizontally extending formation which may vary from about 20 feet in depth to about 500 feet in depth, and may extend through a horizontal range typically from about 500–4,000 feet. The horizontal well bore is preferably reinforced by a slotted liner (not illustrated) which is supported by an annular deposit of cement. The packers 10, 100 isolate the fracture zones Z1, Z2.

The auxiliary conduit 108 is extended through the packer 10 and through the packer 100 for sensing well conditions in zone 2. A second auxiliary conduit 110 is extended through the packer 10 for sensing the well conditions within zone 1. A third auxiliary conduit 112 is routed to the packer 10 for sensing well conditions in a third zone, if desired. It will be appreciated that multiple packers can be extended through the horizontal bore for isolating multiple producing zones over several hundred or several thousand feet in a horizontal completion. The packer 10 and packer 100 are particularly well suited for such horizontal completions since the relatively short, compact packers 10, 100 can negotiate short, medium and long radius bend sections.

Figure 6:
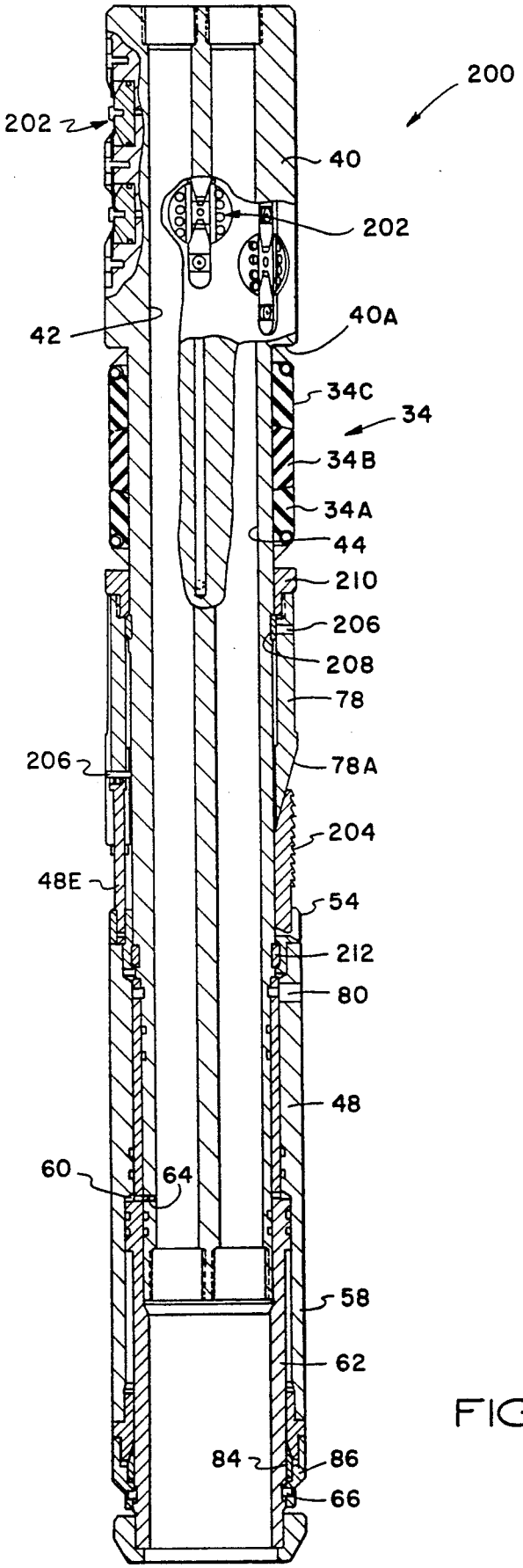

Referring now to FIG. 6, a retrievable dual hydraulic packer 200 is representative of yet another embodiment of the present invention. The packer 200 has a 10,000 psi pressure rating, and is designed for 9⅞ inch, 62.8 pound casing. This packer embodiment includes a solid, one-piece hold down body mandrel 40 which is intersected by dual bores 42, 44. Each bore begins and is terminated with a premium box thread. The packer components are organized and mounted onto the short mandrel 40 which enables it to negotiate short, medium and long radius bends and to withstand high collapse pressures on the setting side of the packer below the seal elements.

The packer 200 is made up on the tubing strings 30, 32 and is run into the well to the desired setting depth. The packer is then actuated by pressuring the auxiliary setting string 32. The packer bores 42, 44 are symmetric with the exception of the setting port; therefore, the determination of the setting side, whether long or short, is dictated by the orientation of the packer bores to the tubing strings. When the setting string is pressurized, the hydraulic fluid passes through the setting port 64 into the pressure chamber 60 between the packer mandrel and setting cylinder. The piston 48 and the setting cylinder 58 are integrally formed.

The hydraulic setting pressure drives the piston 48 and cylinder 58 upwardly, thereby separating the setting shear screws 66. After shear screw separation, the piston 48 pushes against the slip carrier 54 to begin deforming the seal element assembly 34. Pins are then sheared between the tie bolts and slip mandrel allowing the bottom slips, slip carrier and cylinder to move further up, thus causing the bottom slips to be extended radially out into engagement with the casing wall. The packer 200 is then held in the set position by the set of spring loaded internal slips 84.

In this split anchor embodiment, anchor button slips 202 carried on the upper end of the packer mandrel 40 are radially extendable in response to downhole pressure for engaging the sidewall of the casing. In this particular embodiment, sixteen anchor button slips 202 are provided. In this embodiment, the anchor buttons 202 take the place of the lower half of the bidirectional slip shown in the packer 10 of FIG. 2. The anchor buttons 202 prevent the packer from moving up the hole due to pressure below the packer. The button slips 202 are actuated by pressure below the elements and do not depend on the pressure in the tubing string. The anchor slip assembly below the seal elements is a unidirectional anchor slip assembly 204 which corresponds with the upper half of the bidirectional slip of FIG. 2.

In the FIG. 6 embodiment, the fixed wedge 78 is releasably connected by a shear pin 206 to an upper snap ring 208 which is mounted within an annular slot formed in the external surface of the packer mandrel 40. The fixed upper wedge 78 is secured and blocked by a retainer collar 210 which abuts the lower seal element 34A. Upon separation of the lower shear screw 66, the upper wedge assembly 78 is pushed upwardly along the packer mandrel by tie bolts 48E. As the piston 48 extends along the packer mandrel, it drives the retainer collar 210 into engagement against the seal element assembly, which extends radially outwardly in response to compression. Upon application of a force required to separate the shear pins 206, the tie bolts 48E telescope inside the tubular wedge 78. At the same time, the anchor slip 204 is extended radially outwardly as it engages the sloping face 78A of the upper wedge 78. The setting force applied to the seal element assembly 34 is reacted by a radial shoulder 40A formed in the packer mandrel 40.

The packer 200 is released by a straight upward pull on either or both of the tubing strings 30, 32. The packer cannot be pulled if there is a pressure differential from below the packer. The upward pull on the packer causes the release screws 80 to shear, thereby allowing the mandrel 40 to move up, and permitting the seal elements 34A, 34B and 34C to relax. Continued upward movement brings the upper snap ring 208 into contact with the element retainer collar 210 and pulls the slip mandrel from beneath the bottom slips. The slip carrier 54, along with the lower pieces of the packer, are then caught by the lower snap ring 212.

While certain preferred embodiments of the invention have been set forth for purposes of disclosure, modification to those embodiments as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. A well packer comprising, in combination:

a body mandrel having an upper end portion and a lower end portion adapted for attachment to an upper tubing string and a lower tubing string, respectively, and having at least one longitudinal flow passage extending therethrough;

a wedge fixed on said body mandrel for limiting longitudinal travel of an anchor slip assembly and reacting setting forces applied thereto;

an anchor slip assembly mounted for longitudinal movement along said body mandrel and engagable against said fixed wedge;

a setting wedge mounted for longitudinal movement along said body mandrel and engagable against said anchor slip assembly;

a seal element assembly mounted for longitudinal movement along said body mandrel and engagable against said movable setting wedge;

force transmitting apparatus movably coupled to said body mandrel and engagable against said seal element assembly for displacing said seal element assembly against said setting wedge; and, a tubular release sleeve having a first end portion releasably coupled to and depending from the lower end portion of said body mandrel and having a second end portion releasably coupled to said force transmitting apparatus.

2. A well packer as defined in claim 1, said fixed wedge being integrally formed with said body mandrel.

3. A well packer comprising, in combination:

a body mandrel having at least one longitudinal flow passage extending therethrough;

a wedge fixed on said body mandrel for limiting longitudinal travel of an anchor slip assembly and reacting setting forces applied thereto;

an anchor slip assembly mounted for longitudinal movement along said body mandrel and engagable against said fixed wedge;

a setting wedge mounted for longitudinal movement along said body mandrel and engagable against said anchor slip assembly;

a seal element assembly mounted for longitudinal movement along said body mandrel and engagable against said movable setting wedge;

force transmitting apparatus movably coupled to said body mandrel and engagable against said seal element assembly for displacing said seal element assembly against said setting wedge, said force transmitting apparatus comprising an annular piston mounted for longitudinal movement in slidable, sealing engagement along said body mandrel for extending said anchor slip assembly and seal element assembly into set engagement against a well casing;

a release sleeve releasably connected to and depending from said packer mandrel; and, a setting cylinder attached to said annular piston, said setting cylinder being disposed in slidable, sealing engagement against said release sleeve.

4. A well packer as defined in claim 3, said setting cylinder having a bore which in combination with said body mandrel, said release sleeve and said annular piston defining an annular pressure chamber.

5. A well packer as defined in claim 3, including a locking slip disposed between said release sleeve and said setting cylinder, said locking slip having ratchet threads engaged against said release sleeve for permitting extension movement of said setting cylinder relative to said release sleeve, while preventing reversal of said extension movement.

6. A well packer as defined in claim 3, said body mandrel having an annular slot, and including a snap ring mounted within said mandrel slot and disposed between said body mandrel and said release sleeve, and including a shear screw connecting said release sleeve to said snap ring.

7. Well completion apparatus comprising, in combination:

a packer including a mandrel having anchor slips and seal elements carried on said packer mandrel for securing said packer in a well casing and sealing therebetween;

a first wedge secured to said packer mandrel and fixed for engagement by said anchor slips for limiting longitudinal travel of said anchor slips and for reacting setting forces transmitted through said anchor slips;

a second wedge movably mounted on said packer mandrel and disposed intermediate said anchor slips and said seal elements;

a hydraulic actuator assembly mounted on said packer mandrel, said hydraulic actuator assembly including an annular piston mounted for longitudinal movement along said packer mandrel for engaging said seal elements and extending said seal elements and anchor slips into set engagement against a well casing; and, release apparatus releasably interconnecting said packer mandrel and said annular piston.

8. Well completion apparatus as defined in claim 7, including apparatus coupled to said annular piston and to said packer mandrel for permitting extension of said piston relative to said packer mandrel while preventing reversal of said extension movement.

9. Well completion apparatus comprising, in combination:

a packer including a mandrel having anchor slips and seal elements carried on said packer mandrel for securing said packer in a well casing and sealing therebetween;

a first tubular wedge secured to said packer mandrel and fixed for engagement by said anchor slips for limiting longitudinal travel of said anchor slips and for reacting setting forces transmitted through said anchor slips;

a second tubular sedge movably mounted on said packer mandrel and disposed intermediate said anchor slips and said seal elements;

a hydraulic actuator assembly mounted on said packer mandrel, said hydraulic actuator assembly including an annular piston mounted for longitudinal movement along said packer mandrel for engaging said seal elements and extending said seal elements and anchor slips into set engagement against a well casing;

apparatus coupled to said annular piston and to said packer mandrel for permitting extension of said piston relative to said packer mandrel while preventing reversal of said extension movement;

a release sleeve depending from said packer mandrel;

a setting cylinder attached to said annular piston; and, said coupling apparatus including an annular locking slip disposed between said release sleeve and said setting cylinder, said locking slip having ratchet threads against said release sleeve for permitting extension movement of said setting cylinder relative to said release sleeve, while preventing reversal of said extension movement.

10. Well completion apparatus as defined in claim 7, said hydraulic actuator assembly comprising:

a release sleeve depending from said packer mandrel; and, a setting cylinder attached to said annular piston, said setting cylinder being disposed in slidable, sealing engagement against said release sleeve, said setting cylinder having a bore which in combination with said body mandrel, said release sleeve and said annular piston defining an annular pressure chamber.

11. In a subterranean well having a perforated casing embedded within a producing formation, a packer engaging said casing and having a mandrel supporting production adjacent the perforated zone of the casing, force transmitting means including an annular piston movably coupled on said packer mandrel for setting an anchor slip assembly and seal element assembly against said casing, and a wedge disposed for engagement with said anchor slip assembly for limiting longitudinal travel of said anchor slip assembly and for reacting setting forces applied to said anchor slip assembly, the improvement comprising:

a release sleeve depending from said packer mandrel; and, a setting cylinder attached to said annular piston, said setting cylinder being disposed in slidable, sealing engagement against said release sleeve, said setting cylinder having a bore which in combination with said body mandrel, said release sleeve and said annular piston defining an annular pressure chamber.

12. The packer improvement as defined in claim 11, including:

a setting shear screw releasably coupling said setting cylinder to said release sleeve; and, a release shear screw releasably coupling said release sleeve to said packer mandrel.

13. The packer improvement as defined in claim 11, including:

an annular locking slip disposed between said release sleeve and said setting cylinder, said locking slip having ratchet threads engaged against said release sleeve for permitting extension movement of said setting cylinder relative to said release sleeve, while permitting reversal of said extension movement.

14. The packer improvement as defined in claim 11, wherein said packer mandrel having an annular slot, and including a snap ring mounted within said mandrel slot and disposed between said body mandrel and said release sleeve, and including a release shear screw releasably connecting said release sleeve to said snap ring.

15. A well packer comprising, in combination:

a body mandrel having at least one longitudinal flow passage extending therethrough;

a wedge fixed on said body mandrel for limiting longitudinal travel of an anchor slip assembly and reacting setting forces applied thereto;

an anchor slip assembly mounted for longitudinal movement along said body mandrel and engagable against said fixed wedge;

a setting wedge mounted for longitudinal movement along said body mandrel and engagable against said anchor slip assembly;

a seal element assembly mounted for longitudinal movement along said body mandrel and engagable against said movable setting sedge;

force transmitting apparatus movably coupled to said body mandrel and engagable against said seal element assembly for displacing said seal element assembly against said setting wedge; and, force reacting apparatus releasably coupled to said body mandrel and to said force transmitting apparatus for reacting setting forces applied to said seal element assembly by said force transmitting apparatus.

16. A well packer comprising, in combination:

a body mandrel having at least one longitudinal flow passage extending therethrough;

a wedge fixed on said body mandrel for limiting longitudinal travel of an anchor slip assembly and reacting setting forces applied thereto;

an anchor slip assembly mounted for longitudinal movement along said body mandrel and engagable against said fixed wedge;

a setting wedge mounted for longitudinal movement along said body mandrel and engagable against said anchor slip assembly;

a seal element assembly mounted for longitudinal movement along said body mandrel and engagable against said movable setting wedge;

force transmitting apparatus movably coupled to said body mandrel and engagable against said seal element assembly for disposing said seal element assembly against said setting wedge, said force transmitting apparatus including an annular piston mounted for slidable, sealing engagement along said body mandrel for extending said anchor slip assembly and sealing elements into set engagement against a well casing; and, force reacting apparatus coupled to said body mandrel and to said force transmitting apparatus for reacting setting forces applied to said seal element assembly by said force transmitting apparatus, said force reacting apparatus including a release sleeve coupled to said packer mandrel and a setting cylinder attached to said annular piston, said setting cylinder being disposed in slidable, sealing engagement against said release sleeve.

17. A well packer as defined in claim 16, said setting cylinder having a bore which in combination with said body mandrel, said release sleeve and said annular piston defining an annular pressure chamber.

18. A well packer as defined in claim 16, including an annular locking slip disposed between said release sleeve and said setting cylinder, said locking slip having ratchet threads engaged against said release sleeve for permitting extension movement of said setting cylinder relative to said release sleeve, while preventing reversal of said extension movement.

19. A well packer as defined in claim 16, said body mandrel having an annular slot, and including a snap ring mounted within said mandrel slot and disposed between said body mandrel and said release sleeve, and including a shear screw releasably connecting said guide tube to said snap ring.

20. A well packer as defined in claim 16, including:

a setting shear screw releasably coupling said setting cylinder to said release sleeve; and, a release shear screw releasably coupling said release sleeve to said packer mandrel.

* * * * *